US007789254B2

(12) United States Patent
Geho

(10) Patent No.: US 7,789,254 B2
(45) Date of Patent: Sep. 7, 2010

(54) SNAP-TOP CLOSURE DEVICE

(75) Inventor: Jeffrey Edward Geho, Aurora, IL (US)

(73) Assignee: Novelis Inc., Toronto, Quebec (CA)

( * ) Notice: Subject to any disclaimer, the term of this patent is extended or adjusted under 35 U.S.C. 154(b) by 1317 days.

(21) Appl. No.: 10/977,228

(22) Filed: Oct. 29, 2004

(65) Prior Publication Data

US 2006/0091100 A1 May 4, 2006

(51) Int. Cl.
*B65D 41/46* (2006.01)
*B65D 43/16* (2006.01)

(52) U.S. Cl. ..... 215/252; 215/306; 215/235; 220/375

(58) Field of Classification Search ..... 215/253, 215/305, 306, 318, 252, 235; 220/375
See application file for complete search history.

(56) References Cited

U.S. PATENT DOCUMENTS

| | | | | | |
|---|---|---|---|---|---|
| 2,961,119 | A | * | 11/1960 | Leach | 220/291 |
| 3,001,657 | A | * | 9/1961 | William | 215/252 |
| 3,001,657 | A | | 9/1961 | Gamble | 215/42 |
| 4,043,475 | A | * | 8/1977 | Wheeler | 215/223 |
| 4,394,918 | A | | 7/1983 | Grussen | 215/243 |
| 4,856,667 | A | | 8/1989 | Thompson | 215/318 |
| 4,896,782 | A | * | 1/1990 | Hawkins et al. | 215/329 |
| 4,919,286 | A | | 4/1990 | Agbay, Sr. | 215/235 |
| 4,923,073 | A | | 5/1990 | Wilde | 215/252 |
| 4,934,556 | A | * | 6/1990 | Kleissendorf | 220/269 |
| 4,941,580 | A | * | 7/1990 | Julian | 215/235 |
| 5,137,163 | A | | 8/1992 | Moore | 215/252 |
| 5,152,416 | A | * | 10/1992 | Cassel | 220/288 |
| 5,215,204 | A | * | 6/1993 | Beck et al. | 215/252 |
| 5,246,125 | A | * | 9/1993 | Julian | 215/252 |
| 5,443,853 | A | | 8/1995 | Hayes | 426/107 |
| 5,660,288 | A | | 8/1997 | Nyman, Jr. | 215/44 |
| 5,660,288 | A | | 8/1997 | Nyman, Jr. | 215/44 |
| 5,697,509 | A | * | 12/1997 | Hayes | 215/235 |
| 5,755,352 | A | | 5/1998 | Wojcik et al. | 220/339 |
| 5,813,553 | A | | 9/1998 | Herr et al. | 215/252 |
| 5,855,288 | A | * | 1/1999 | Dallas, Jr. | 215/228 |

(Continued)

FOREIGN PATENT DOCUMENTS

| | | |
|---|---|---|
| CA | A1 2490350 | 12/2003 |

(Continued)

*Primary Examiner*—Anthony Stashick
*Assistant Examiner*—James N Smalley
(74) *Attorney, Agent, or Firm*—Cooper & Dunham LLP

(57) ABSTRACT

A tamper-evident, re-closable container is disclosed, comprising a container body, having a neck portion with a cammed projection, and a mouth rimmed by a lip and a closure having a top portion with a groove to rotatably engage and seal against the lip of the container, and a bottom portion having a contour formed therein to rest under the cammed projection. A breakable tamper-evident section circumferentially connects the top portion of the container to the bottom portion of the container and connecting means connects the top portion to the bottom portion. Rotation of the closure around the mouth of the container causes the cammed projection to force the bottom portion downwardly to break the tamper-evident section. A tamper-evident closure is also described for use with a re-closable container, having a top portion that can be rotated around a mouth of the container to cause a tamper-evident section to break.

13 Claims, 4 Drawing Sheets

U.S. PATENT DOCUMENTS

| | | | | |
|---|---|---|---|---|
| 5,860,542 | A | 1/1999 | Takamatsu | 215/44 |
| 5,944,207 | A * | 8/1999 | Reidenbach | 215/243 |
| 5,947,309 | A * | 9/1999 | Anderson | 215/44 |
| 6,234,334 | B1 | 5/2001 | Suarez | 215/237 |
| 6,253,937 | B1 | 7/2001 | Anderson | 215/235 |
| 6,264,051 | B1 * | 7/2001 | Reidenbach | 215/237 |
| 6,394,295 | B2 * | 5/2002 | Claude | 215/318 |
| 6,460,712 | B2 * | 10/2002 | Smith et al. | 215/235 |
| 6,530,493 | B2 | 3/2003 | Anderson | 215/235 |
| 7,040,499 | B1 * | 5/2006 | Reif | 220/291 |
| 2001/0035389 | A1 | 11/2001 | Anderson | 215/235 |
| 2005/0242054 | A1 * | 11/2005 | Stull et al. | 215/252 |

FOREIGN PATENT DOCUMENTS

| | | |
|---|---|---|
| DE | A1 2856433 | 7/1980 |
| GB | 2 367 802 | 4/2000 |
| WO | WO 9402371 A1 * | 2/1994 |

* cited by examiner

SNAP-TOP CLOSURE DEVICE

FIELD OF THE INVENTION

The present invention relates to a closure device for use on containers, and in particular on disposable beverage containers.

BACKGROUND OF THE INVENTION

In the field of food and beverage packaging, there is an increasingly high demand for quality assurance. More specifically, it is very important to provide means for ensuring that the product has not been tampered with at any stage between the initial packaging and final consumption by the user. A variety of tamper-evident closures have been developed to meet this need.

The current and most widely used closures for containers, such as beverage containers, tend to come completely off from the container when unscrewed and can be lost before the contents are consumed. Once lost, re-closure of the partially full container is no longer possible. Some closures have been developed as two part closures, with a lower portion that is connected to both the container and a top sealing portion, thereby preventing loss of the top portion. However, the lower portion, which is fixed to the container proximate a mouth of the container, tends to be cumbersome and can get in the way of the consumers lips when the beverage is being consumed.

To provide tamper evidence, closures are often sealed to the container by a sealing membrane which must be separately discarded once the container is opened. In the case of two part closures, the top portion is often sealed to the lower portion, the seal generally being breakable through the action of opening the container. However, in many cases, breaking the seal involves holding the lower portion in place while turning or flipping open the top portion, making it quite awkward to use. As well, proximity of the lower portion to the mouth of the container makes consumption difficult.

U.S. Pat. No. 6,253,937 (Anderson) discloses a two-part snap-top closure that screws onto the neck of a bottle opening. There is no disclosure of sealing the lower portion to the top portion or rotating the entire cap to separate the lower portion from the upper portion. As well, in the reference the two parts of the closure are required to snap fit with each other. U.S. Pat. No. 6,530,493 and U.S. Application 2001/0035389 are related to the Anderson reference.

U.S. Pat. No. 6,234,334 (Suarez) teaches a two part cap having an arrangement in which the parts snap to each other rather than to a lip of the container. This device completely covers the mouth of the container and requires that an additional spout means be formed into the closure.

U.S. Pat. No. 5,755,352 (Wojcik et. al) also teaches that the two parts of the cap snap to each other and there is no teaching of rotation of the lower part to cause separation from the upper part. The lower part is engaged to the container neck, so that the upper part and lower part remain near the mouth of the container when the beverage is consumed.

U.S. Pat. No. 4,856,667 discloses a neck sealing arrangement, but it does not specifically relate to a two-part cap.

U.S. Pat. No. 5,813,553 discloses a multiple-part cap but is principally concerned with a tamper-evident construction and does not provide means by which the closure can remain connected to the container, to prevent loss of the closure.

Finally, British Patent 2,367,802 discloses a device for carrying a bottle and consists of two parts that snap-fit together.

It is therefore greatly desired to develop a closure device for a container that is tamper-evident, while also connecting the closure to the container and allowing the closure device to be moved sufficiently out of the way to allow the users mouth to engage the container.

SUMMARY OF THE INVENTION

The present invention provides a tamper-evident, re-closable container that comprises a container body, having a neck portion with a cammed projection, and a mouth rimmed by a lip and a closure having a top portion with a groove to rotatably engage and seal against the lip of the container, and a bottom portion having a contour formed therein to rest under the cammed projection. A breakable tamper-evident section circumferentially connects the top portion of the container to the bottom portion of the container and connecting means connects the top portion to the bottom portion. Rotation of the closure around the mouth of the container causes the cammed projection to force the bottom portion downwardly to break the tamper-evident section.

The present invention also provides a tamper-evident closure for use with a container having a neck portion with a cammed projection, and a mouth rimmed by a lip. The closure comprises a top portion with a groove to rotatably engage and seal against the lip of the container and a bottom portion having a contour formed therein to rests under the cammed projection. A breakable tamper-evident section circumferentially connects the top portion of the container to the bottom portion of the container and connecting means connect the top portion to the bottom portion. Rotation of the top portion around the mouth of the container causes the cammed projection to force the bottom portion downwardly to break the tamper-evident section.

For the purposes of the present invention, the term "lip" is used to mean a slightly flared or projecting portion extending from the mouth of the container.

BRIEF DESCRIPTION OF THE DRAWINGS

A preferred embodiment of the present invention is described below, in conjunction with the accompanying figures, wherein.

DETAILED DESCRIPTION OF THE PREFERRED EMBODIMENTS

The invention comprises a one-piece container closure, having a top portion designed to snap around the mouth of a container and that is attached by a connecting means and a tamper-evident section to a bottom portion.

To open the container, the user twists the closure causing separation at the tamper-evident section, so that the top portion can now be snapped open and remains attached to the bottom portion by the connecting means. The top portion can be snapped back onto the container to re-close the container or alternatively the top portion can be removed from the container for recycling purposes, after consumption of the contents of the container.

Figure 1A:
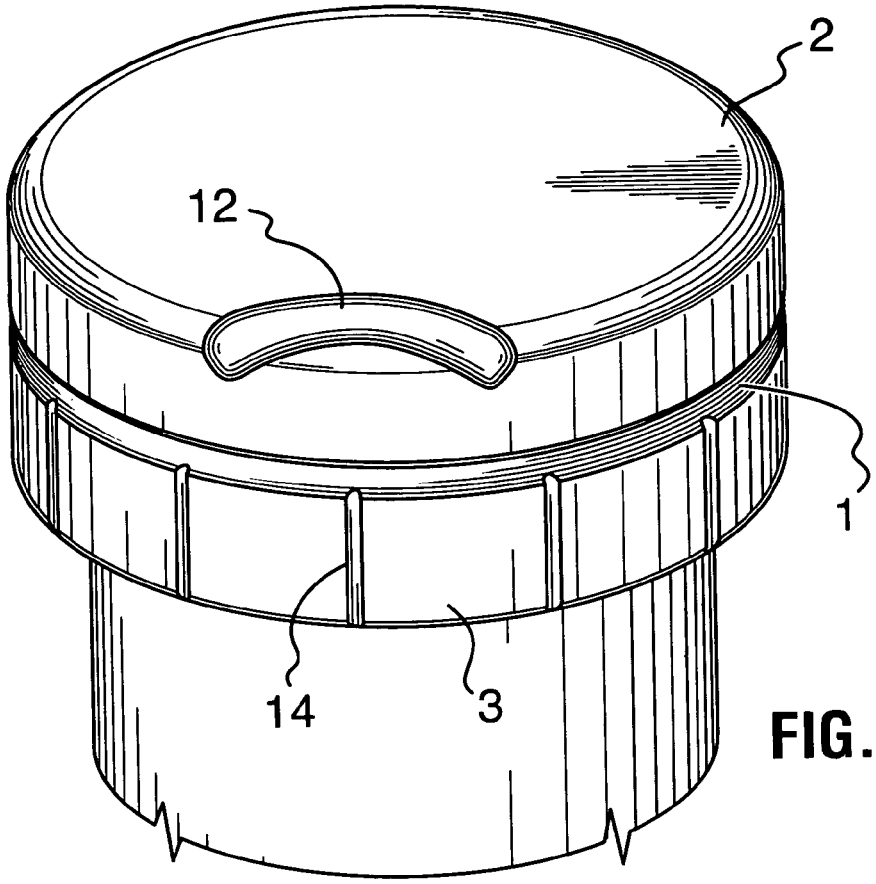
FIG. 1 is a front perspective view, with partial cut out, of a preferred embodiment of the device of FIG. 1 in a closed position.
Figure 1B:
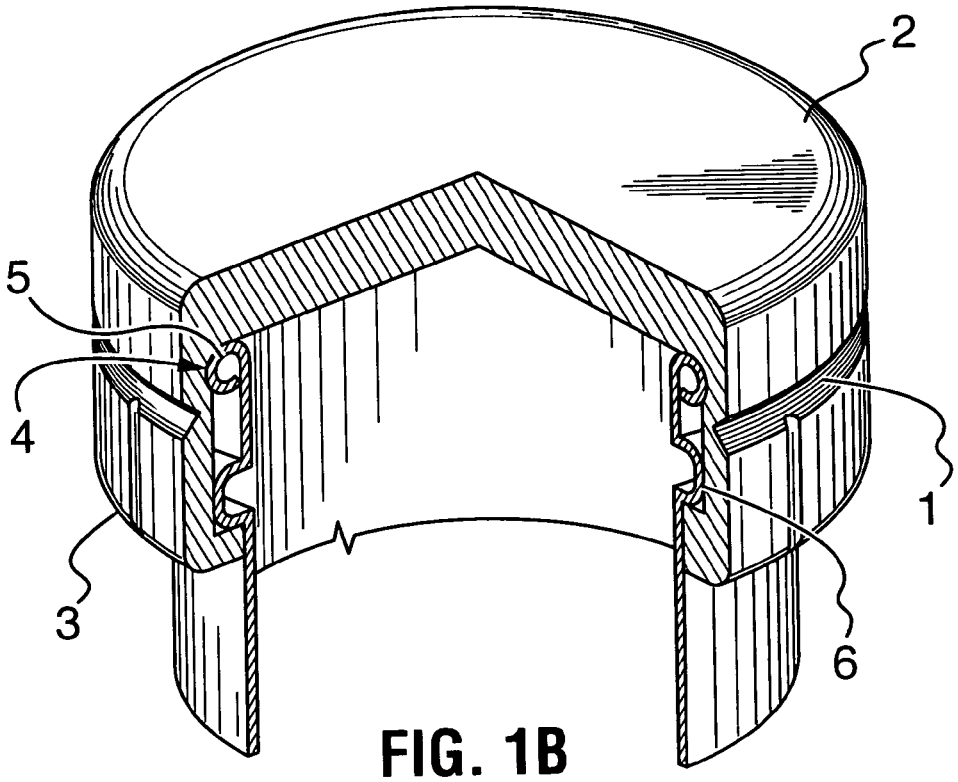

With reference to FIG. 1, a closure is provided, made of a top portion 2 and a bottom portion 3, which are initially attached to one another by a breakable, tamper-evident section 1 that runs circumferentially. A bead groove 4 is formed in the top portion 2 of the closure. The bead groove 4 is designed to snap around a bead or lip 5 at a mouth of the container. The bottom portion 3 of the closure is formed to mate with a corresponding cammed projection 6 on a neck of the container. The bottom portion 3 is otherwise unconnected to the container, and is held in place just below the mouth of the container only by its connection to the top portion, through the tamper-evident section.

Figure 2:
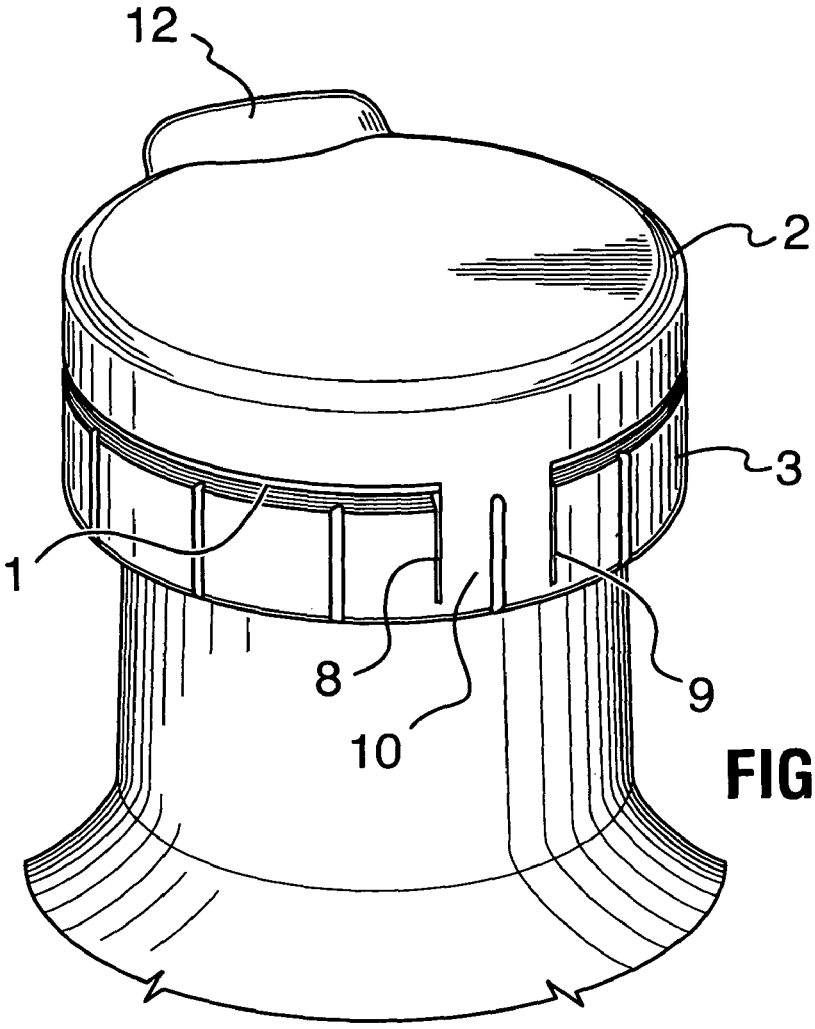
FIG. 2 is a rear perspective view of the device of FIG. 1 in a closed position.

The top portion 2 and bottom portion 3 are connected to one another by connecting means, for example a hinged section, as illustrated in FIG. 2. In this figure, two vertically running slits 8 and 9 are formed in the bottom portion 3 of the closure to provide a hinged section 10 that interrupts the breakable, tamper-evident section 1.

Figure 3:
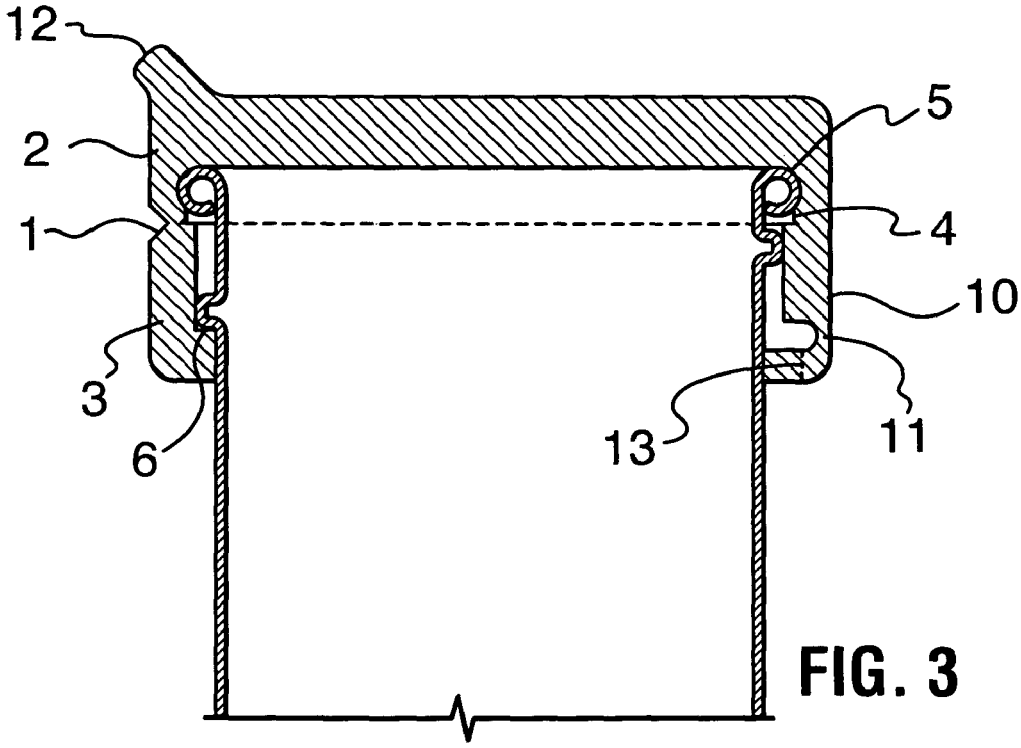
FIG. 3 is a cross sectional view of the device of the FIG. 1 in a closed position.
Figure 5:
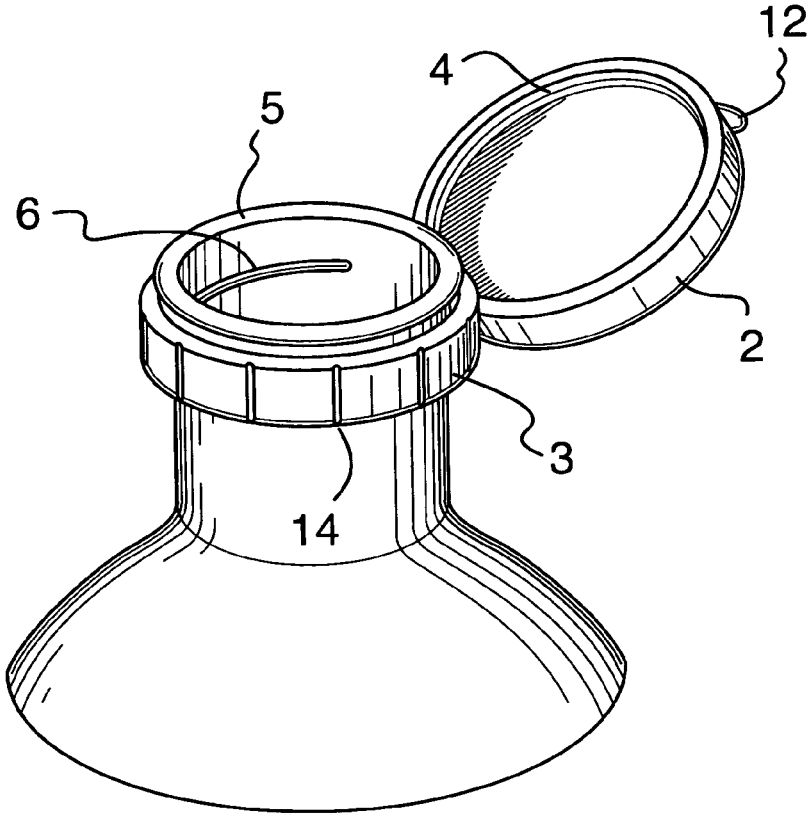
FIG. 5 is a second front perspective view of the device of FIG. 1 in an open position.

More preferably, a flexible joint 11 in the bottom portion 3 is shown in FIG. 3 that can run between slits 8 and 9 and act as a hinge to allow the top portion 2 to be disengaged from the container, but remain connected to the bottom portion 3. This is configuration is shown in FIG. 5. The hinged section 10 also includes a breakable section 13 that can be easily fractured or torn so that the top portion 2 of the closure can be removed from the container for recycling purposes.

In an alternate embodiment, a flexible, thin C-shaped strip can be used to connect the top portion 2 to the bottom portion 3.

An optional thumb lever 12 provides traction for unsnapping the top portion 2 of the closure from the container mouth once the tamper-evident section 1 has been fractured by twisting the closure.

The closure can be applied to the container by a number of means, and are not limited to those discussed below, which serve only to illustrate options for application. In one embodiment, the closure is formed of two pieces. The first piece comprises the cam-mating formation and can be placed on the underside of the cam on the container. The second piece comprises the bead groove 4 and can be slid over the lip 5 and the cammed projection 6 and locked onto the first piece by a one way locking feature or can be glued to the first piece.

In another embodiment, one-way flexible threads can be formed on the bottom portion 3 of the closure, which flex outwardly when the closure is pushed onto the container, to slip over the cammed projection 6. The threads then springs back, thereby preventing the closure from being pulled off without opening the closed container.

Any suitable and well known anti-backing off measure can be applied to the present invention to prevent the closure from being removed from the container without breaking the tamper evident section 1. In one illustrative example of such anti-backing off measure, the threads or the cammed projection 6 on the container have ratcheted surfaces that mate with opposing ratcheted surface in the closure when the closure is initially applied to the container. The mated ratcheted portions prevent the closure from being screwed off if twisted in an opposite direction.

Figure 4:
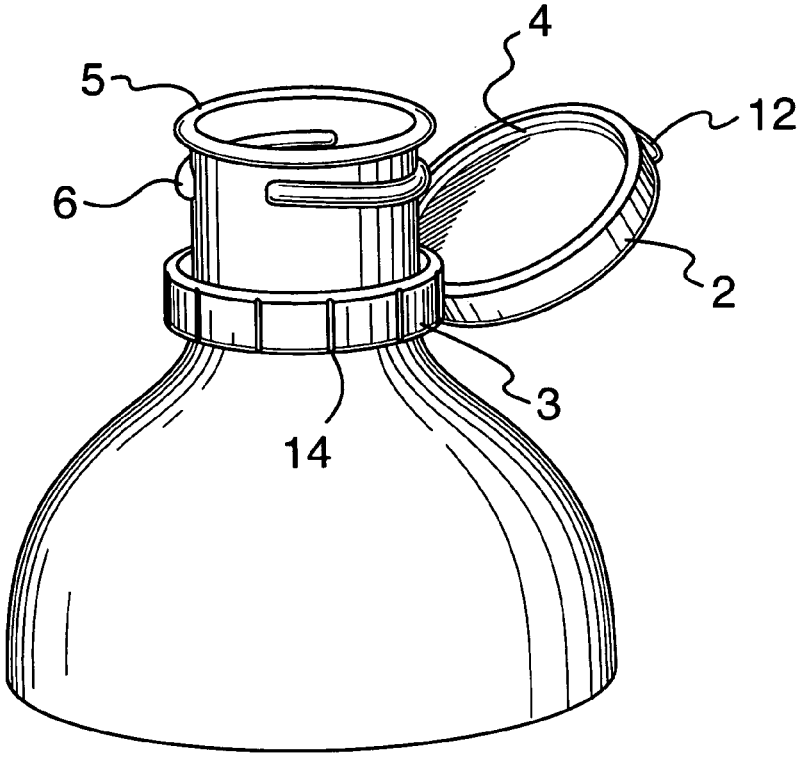
FIG. 4 is a front perspective view of the device of FIG. 1 in an open position.

The device of the present invention operates by first twisting the closure. As the closure is twisted, the cammed projection 6 causes the bottom portion 3 to move further down towards the base of the container while the top portion 2 of the closure remains at a constant level on the mouth of the container. This action puts a high level of stress on the tamper-evident section 1, causing it to fracture. The top portion 2 of the closure can then be unsnapped from the lip 5 on the mouth of the container, thus opening the container. In a preferred embodiment, the thumb lever 12 can then be used for unsnapping the closure. Since the bottom portion 3 is not fixed to the container, the entire closure tends to fall down the neck of the container after opening, as seen in FIG. 4.

The term "cammed projection" is used throughout the description of the present invention, however it is to be understood that embodiments such as, for example, a threaded section encircling the neck of the container, thread segments, or an undulated sinusoidal wave form around the neck of the container, are encompassed by this term. The cammed projection is formed so that the number of rotations required to fracture the tamper-evident section 1 is minimized, and is preferably from ¼ to 4 rotations.

The top portion 2, which remains attached to the bottom portion 3 by the hinged section 10, can also be slid down towards the base of the container so that the mouth of the container is kept free from obstruction while the contents are being consumed. The closure can then be snapped back onto the container, thus re-closing the container if the contents are not consumed in one sitting.

Preferably, flutes, ribs or other geometric features 14 can be added to the bottom portion 3 to provide a gripping surface between a user's hand and the closure, to aid in twisting the closure.

Figure 6A:
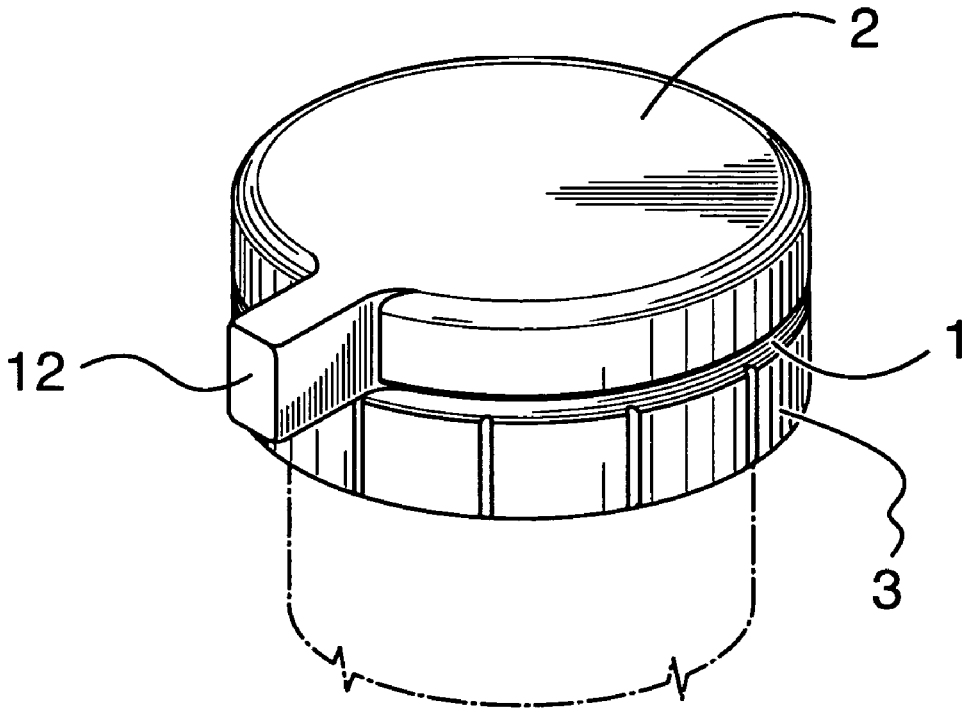
FIG. 6*a* is a cross-sectional view of an alternative embodiment of the device of FIG. 1.
Figure 6B:
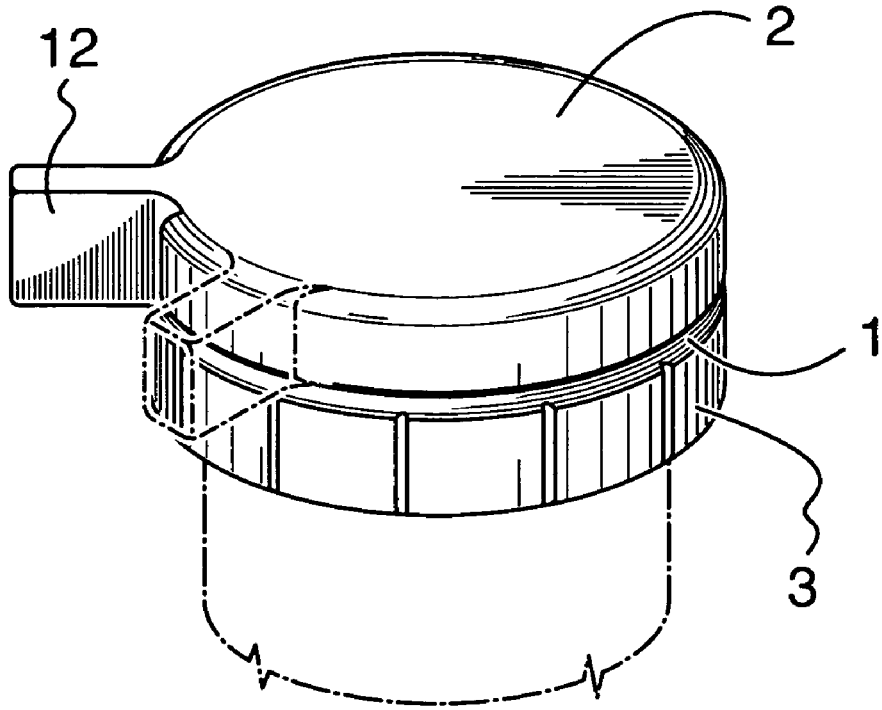
FIG. 6*b* is a top plan view of an alternative embodiment of the device of FIG. 1.

In another embodiment, as illustrated in FIGS. 6A and 6B, the optional thumb lever 12 may be shaped to allow the user to break the tamper-evident section and open the closure using one hand. In this case, the container is held in one hand and the thumb of the same hand is used to push on the thumb lever causing rotation of the top portion 2 of the closure using the thumb lever 12. The thumb lever 12 provides a leverage structure so that a sufficient amount of force can be comfortably generated by a person to rotate the closure on the container, thus causing the tamper evident section to break. In further embodiments (not shown), the thumb lever can be formed in the bottom portion 3 of the closure to facilitate rotation of the closure, or on each of the top portion 2 and the bottom portion 3 to facilitate both rotation of the closure and snapping off of the top portion.

In a further embodiment, the bottom portion 3 of the closure can be formed to mate with a lowermost thread of any conventional threaded plastic beverage container. In this embodiment, the top portion 2 of the closure can be formed to engage the mouth of the container by, for example, making the inside diameter of the top portion 2 nominally smaller than the outside diameter of the mouth of the container so that the top portion 2 squeezingly engages the mouth. This latter embodiment would preferably apply to low carbonation or non-carbonated beverage applications.

In a further optional embodiment, a compound may be added to the bead groove 4 of the top portion 2 to ensure a snug mating with the lip 5. This embodiment is particularly useful in packaging carbonated beverages, in which gas can easily escape from the container. The addition of a compound acts to fill any gaps between the lip 5 and the bead groove 4 that may occur due to surface defects on the bead groove 4 or lip 5 and which could allow for gasses to escape. The compound can be similar to those used in crowns or plastic closures used on beverage containers. The actual composition and form of the compound will depend upon the substance held within the container.

This detailed description of the methods and products is used to illustrate the prime embodiment of the present invention. It will be obvious to those skilled in the art that various modifications can be made in the present device and that various alternative embodiments can be utilized. Therefore, it will be recognized that various modifications can be made in the products of the present invention and in the applications to which the products are applied without departing from the scope of the invention, which is limited only by the appended claims.

What is claimed is:

1. A tamper-evident, re-closable container, comprising:

a. a container body, having a neck portion with a cammed projection, and a mouth rimmed by a lip;

b. a closure having a snap-open top portion provided with a groove to rotatably engage and seal against the lip of the container, with the groove and lip forming the only interengagement between the top portion of the closure and the neck portion of the container, and a bottom portion having a contour formed therein to rest under the cammed projection;

c. a breakable tamper-evident section circumferentially connecting the top portion of the closure to the bottom portion of the closure; and d. connecting means additional to said tamper-evident section connecting the top portion to the bottom portion;

whereby rotation of the closure around the mouth of the container causes the cammed projection to move the bottom portion downwardly to break the tamper-evident section while the top portion remains at a constant level on the mouth of the container.

2. The container of claim 1, further comprising a thumb lever, projecting from the top portion, engagable by a user's thumb to snap the top portion off of the mouth of the container.

3. The container of claim 2, wherein the thumb lever is contoured to facilitate rotation of the closure and corresponding breakage of the tamper-evident section, by applying pressure thereon.

4. The container of claim 1, wherein the cammed projection comprises a threaded section encircling the neck of the container.

5. The container of claim 1, wherein the cammed projection comprises thread segments formed around the neck of the container.

6. The container of claim 1, wherein the cammed projection comprises an undulated sinusoidal wave form around the neck of the container.

7. The container of claim 1, further comprising flutes or ribs formed on the bottom portion to provide a gripping surface between a user's hand and the closure.

8. The container of claim 1, wherein the connecting means comprises a hinged section interrupting the tamper-evident section and movably connecting the top portion to the bottom portion.

9. The container of claim 8, wherein the hinged section further comprises a flexible joint, located in the bottom portion that allows the top portion to be snapped off the container, while remaining connected to the bottom portion.

10. The container of claim 9, wherein the hinged section further comprises a breakable section that can be fractured, thereby permitting the top portion of the closure to be separated from the container for recycling purposes.

11. The container of claim 1 wherein the connecting means comprises a thin C-shaped strip, movably connecting the top portion to the bottom portion.

12. The container of claim 1, wherein the bottom portion and the cammed projection are formed such that the tamper-evident section breaks when the closure is rotated around the mouth of the container between ¼ to 4 rotations.

13. The container of claim 1, wherein a compound is added to the groove of the top portion to enhance sealing against the lip of the container.

* * * * *